US007476151B2

(12) United States Patent
Jaffe et al.

(10) Patent No.: US 7,476,151 B2
(45) Date of Patent: Jan. 13, 2009

(54) AWARD DISPLAY FOR GAMING MACHINE HAVING EXTENDABLE AND RETRACTABLE ELEMENTS

(75) Inventors: Joel R. Jaffe, Evanston, IL (US); William R. Wadleigh, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 857 days.

(21) Appl. No.: 10/612,419

(22) Filed: Jul. 2, 2003

(65) Prior Publication Data

US 2005/0003879 A1 Jan. 6, 2005

(51) Int. Cl.
*A63F 9/24* (2006.01)

(52) U.S. Cl. ..... 463/16

(58) Field of Classification Search ..... None
See application file for complete search history.

(56) References Cited

U.S. PATENT DOCUMENTS

| | | | | |
|---|---|---|---|---|
| 5,344,145 | A | 9/1994 | Chadwick et al. | 273/138 A |
| 5,429,507 | A * | 7/1995 | Kaplan | 463/30 |
| 5,848,932 | A | 12/1998 | Adams | 463/20 |
| 5,882,261 | A | 3/1999 | Adams | 463/20 |
| 6,537,152 | B2 | 3/2003 | Seelig et al. | 463/30 |
| 6,814,665 | B2 * | 11/2004 | Seelig et al. | 463/25 |
| 2002/0094861 | A1 * | 7/2002 | Seelig et al. | 463/20 |
| 2002/0183109 | A1 | 12/2002 | McGahn et al. | 463/20 |
| 2003/0040358 | A1 * | 2/2003 | Rothkranz et al. | 463/20 |
| 2003/0060265 | A1 | 3/2003 | Webb | 463/20 |
| 2003/0064790 | A1 * | 4/2003 | Hughs-Baird et al. | 463/20 |
| 2003/0064806 | A1 * | 4/2003 | Gordon et al. | 463/42 |
| 2003/0069066 | A1 | 4/2003 | Seelig et al. | 463/20 |
| 2004/0043811 | A1 * | 3/2004 | Seelig et al. | 463/16 |
| 2004/0053658 | A1 * | 3/2004 | Rothranz | 463/16 |
| 2004/0053671 | A1 * | 3/2004 | Nordman | 463/20 |
| 2004/0053687 | A1 * | 3/2004 | Nordman et al. | 463/30 |
| 2004/0180711 | A1 * | 9/2004 | Seelig et al. | 463/16 |
| 2005/0049028 | A1 * | 3/2005 | Gornez et al. | 463/20 |
| 2005/0054424 | A1 * | 3/2005 | Rothkranz et al. | 463/20 |
| 2005/0059454 | A1 * | 3/2005 | McComb et al. | 463/16 |
| 2006/0019733 | A1 * | 1/2006 | D'Avanzo | 463/16 |

FOREIGN PATENT DOCUMENTS

| | | |
|---|---|---|
| GB | 2 391 682 A | 5/2002 |
| GB | 2 393 016 A | 9/2003 |
| WO | WO 2004/002558 | 3/2004 |
| WO | WO 2004/025587 | 3/2004 |

* cited by examiner

*Primary Examiner*—Robert E Pezzuto
*Assistant Examiner*—Tramar Harper
(74) *Attorney, Agent, or Firm*—Nixon Peabody LLP

(57) ABSTRACT

A gaming apparatus for conducting a wagering game comprises an electro-mechanical award display including a plurality of physical elements. A processor is operative to record a wager to play the wagering game and, in response to a predetermined criterion, move the physical elements between an extended position and a retracted position to indicate a game outcome.

20 Claims, 8 Drawing Sheets

AWARD DISPLAY FOR GAMING MACHINE HAVING EXTENDABLE AND RETRACTABLE ELEMENTS

FIELD OF THE INVENTION

The present invention relates generally to gaming machines and, more particularly, to a gaming machine having an electro-mechanical award display with physical elements movable between an extended position and a retracted position to indicate a game outcome.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator.

To enhance the entertainment value of a gaming machine, gaming machines may include features such as an enhanced payoff and a "secondary" or "bonus" game which may be played in conjunction with a "basic" game. The bonus game may comprise any type of game, either similar to or completely different from the basic game, which is entered upon the occurrence of a selected event or outcome of the basic game. Generally, the features provide a greater expectation of winning than the basic game. Additionally, more attractive or unusual video displays and/or audio may accompany the basic and bonus games. The fanciful and visually appealing displays offer tremendous advantages in player appeal and excitement relative to other known games. Such games are attractive to both players and operators. Thus, there is a continuing need to develop new features for the displays and the basic and bonus games to satisfy the demands of players and operators. Preferably, such new features will maintain, or even further enhance, the level of player excitement. The present invention is directed to satisfying these needs.

SUMMARY OF THE INVENTION

In accordance with the foregoing, a gaming apparatus for conducting a wagering game comprises an electro-mechanical award display including a plurality of physical elements. A processor is operative to record a wager to play the wagering game and, in response to a predetermined criterion, move the physical elements between an extended position and a retracted position to indicate a game outcome. The apparatus includes a housing, and the physical elements preferably move inward and outward relative to a panel of the housing.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The foregoing and other advantages of the invention will become apparent upon reading the following detailed description and upon reference to the drawings in which.

Figure 1:
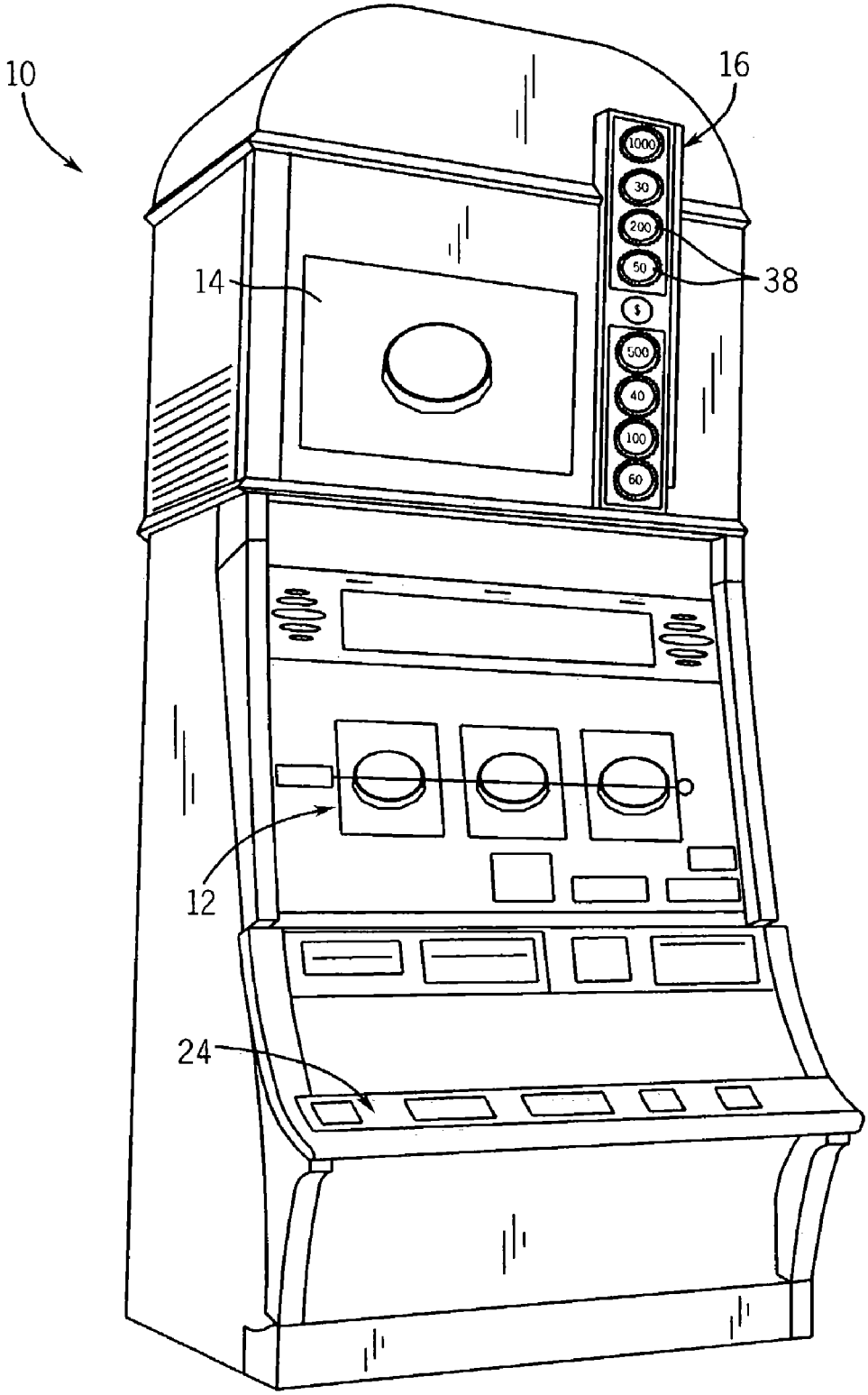
FIG. 1 is a perspective view of a gaming machine in accordance with one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is shown a gaming machine 10 for conducting a wagering game in accordance with the present invention. The gaming machine 10 comprises a primary display 12 and a number of secondary displays 14 and 16. The display 12 may be a mechanical reel slot display or a video display. The display 14 is preferably a video display. The display 16 is an electro-mechanical award display including a plurality of physical elements 38 movable between an extended position and a retracted position to indicate an outcome. The display 12 (if implemented in video) and the display 14 may comprise a cathode ray tube (CRT), liquid crystal display (LCD), plasma, or generally any other type of video display known in the art. In the illustrated embodiment, the gaming machine 10 is an "upright" version in which the display 12 is oriented vertically relative to the player. It will be appreciated, however, that any of several other models of gaming machines are within the scope of the present invention including, for example; a "slant-top" version in which the display 12 is slanted at about a thirty-degree angle toward the player.

Figure 2:
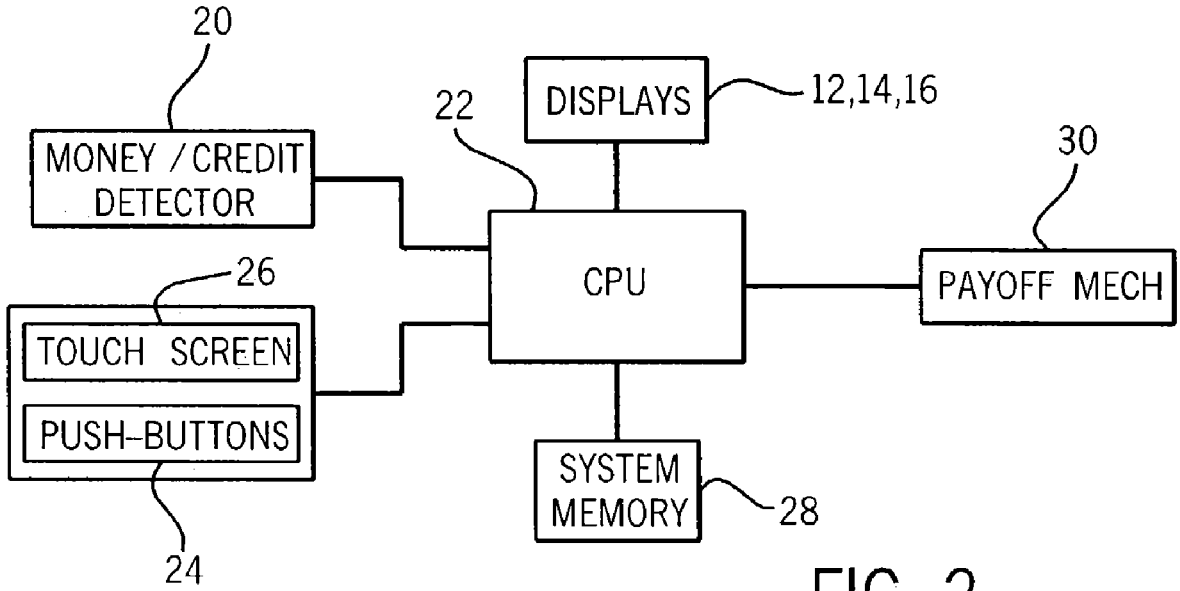
FIG. 2 is a block diagram of a control system suitable for operating the gaming machine.

FIG. 2 is a block diagram of a control system suitable for operating the gaming machine. Money/credit detector 20 signals a central processing unit (CPU) 22 when a player has inserted money or played a number of credits. The money may be provided by coins, bills, tickets, coupons, cards, etc. Using a button panel 24 (see FIG. 1) or a touch screen 26, the player may select any game variables (e.g., number of pay lines in a reel slot game if more than one can be selected) and place his/her wager to play the wagering game. In a play of the game, the CPU 22 generates at least one random event using a random number generator (RNG) and provides an award to the player for a winning outcome of the random event. The CPU 22 operates the displays 12, 14, and 16 to represent the random event(s) and outcome(s) in a visual form that can be understood by the player. In addition to the CPU 22, the control system may include one or more additional slave control units for operating one or more of the displays. The terms "processor" and CPU as used herein are each intended to collectively cover the CPU 22 and any and all such control units.

A system memory 28 stores control software, operational instructions and data associated with the gaming machine. In one embodiment, the system memory 28 comprises a separate read-only memory (ROM) and battery-backed random-access memory (RAM). However, it will be appreciated that the system memory 28 may be implemented on any of several alternative types of memory structures or may be implemented on a single memory structure. A payoff mechanism 30 is operable in response to instructions from the CPU 22 to award a payoff to the player. The payoff may, for example, be in the form of a number of credits. The number of credits are determined by one or more math tables stored in the system memory 28.

The wagering game is described below wherein the basic game is a single pay line, mechanical reel slot game. It should, however, be understood that the basic game may be any type of wagering game, including but not limited to video reel slots, poker, keno, bingo, blackjack, or roulette.

Figure 3:
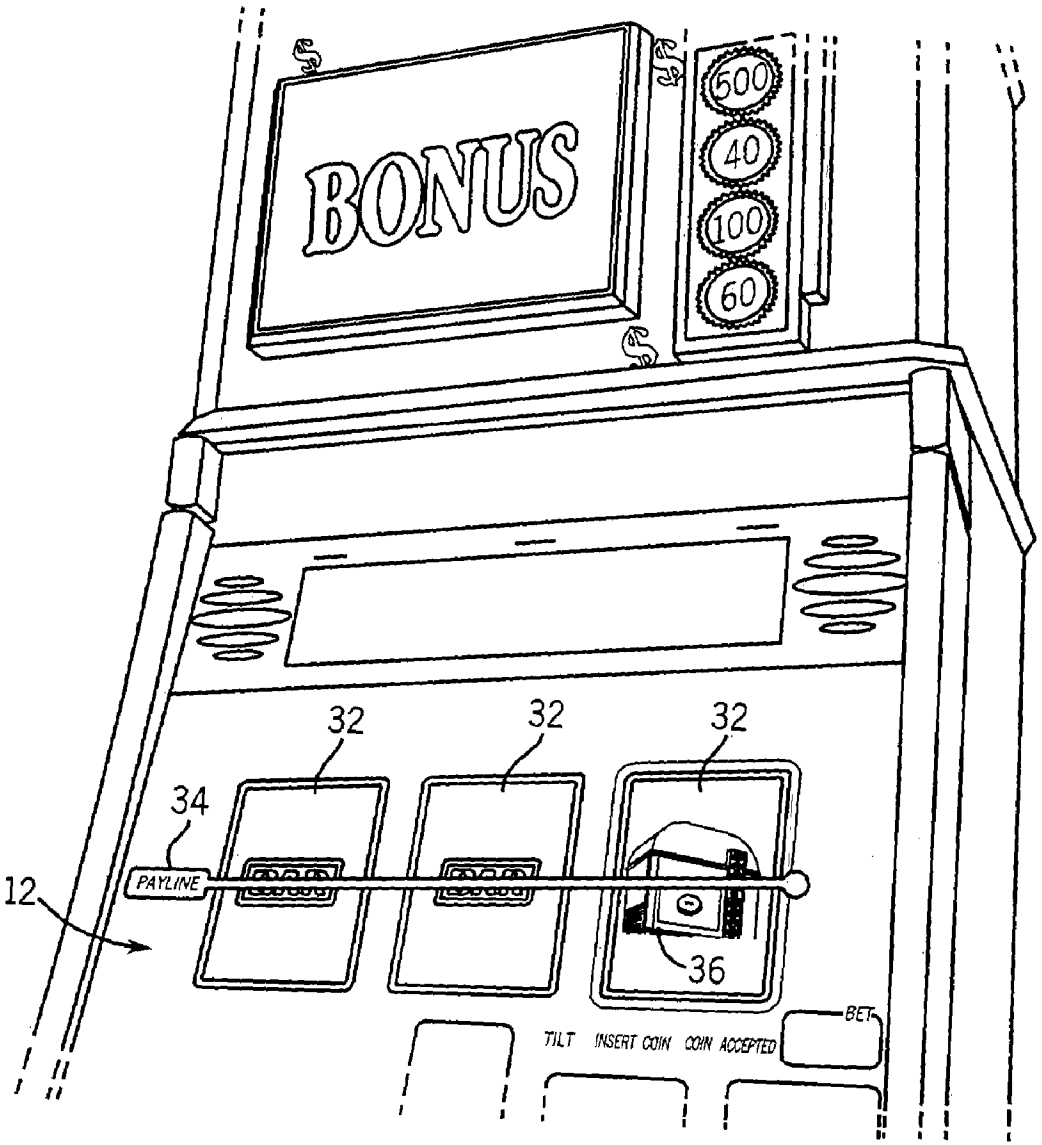
FIG. 3 is an enlarged perspective view of a primary display of the gaming machine, showing a start-bonus outcome for triggering a bonus game.

Referring to FIG. 3, to play the basic reel slot game, a player places a wager using a "bet one" key or a "max bet" key on the button panel 24 (see FIG. 1). In response to pressing the "max bet" key, or a "spin reels" key for a wager less than the maximum, the CPU spins and randomly stops a plurality of symbol-bearing reels 32 to place symbols on the reels 32 in visual association with at least one pay line 34. Other mechanisms, such as a handle, may be used to set the reels 32 in motion. Additional pay lines may be provided, in which case the player is allowed to wager on more than one pay line. The number of illustrated reels is three but a different number of reels may be provided if desired. As noted above, the display 12 on which the reels are implemented may be mechanical or video. If the display 12 is mechanical, the reels are physical and rotatably driven by stepper motors. If, however, the display 12 is video, the reels are simulated with moving graphics.

The CPU uses a random number generator to select a game outcome (e.g., "basic" game outcome) corresponding to a particular set of reel "stop positions." The CPU then causes each of the reels 32 to stop at the appropriate stop position. Symbols are displayed on the reels 32 to graphically illustrate the reel stop positions and indicate whether the stop positions of the reels 32 represent a winning game outcome.

Winning basic game outcomes (e.g., symbol combinations resulting in payment of coins or credits) are identifiable to the player by a pay table. The pay table may be affixed to the machine 10 and/or displayed by a video display (e.g., display 14) in response to a command by the player (e.g., by pressing a "pay table" key on the button panel 24). A winning basic game outcome occurs when the symbols appearing on the reels 32 along the pay line 34 correspond to one of the winning combinations on the pay table. A winning combination could, for example, be two or more matching symbols along the pay line 34, where the award is greater as the number of matching symbols along the pay line 34 increases. If the displayed symbols stop in a winning combination, the game credits the player an amount corresponding to the award in the pay table for that combination multiplied by the number of wagered credits. The player may collect the amount of accumulated credits by pressing a "collect" key on the button panel 24.

Included among the plurality of basic game outcomes are one or more start-bonus outcomes for triggering play of bonus games. A start-bonus outcome may be defined in any number of ways. For example, a start-bonus outcome may occur when a special start-bonus symbol or a special combination of symbols appears on one or more of the reels 32. A start-bonus outcome may require the combination of symbols to appear along the pay line 34, or may alternatively require that the combination of symbols appear anywhere on the display regardless of whether the symbols are along the pay line 34. The appearance of a start-bonus outcome causes the CPU to shift operation from the basic slot game to the bonus game associated with that start-bonus outcome. In the illustrated example, a Beverage Machine symbol 36 along the pay line 34 with a maximum wager (e.g., 3 credits) triggers the bonus game.

Figure 4:
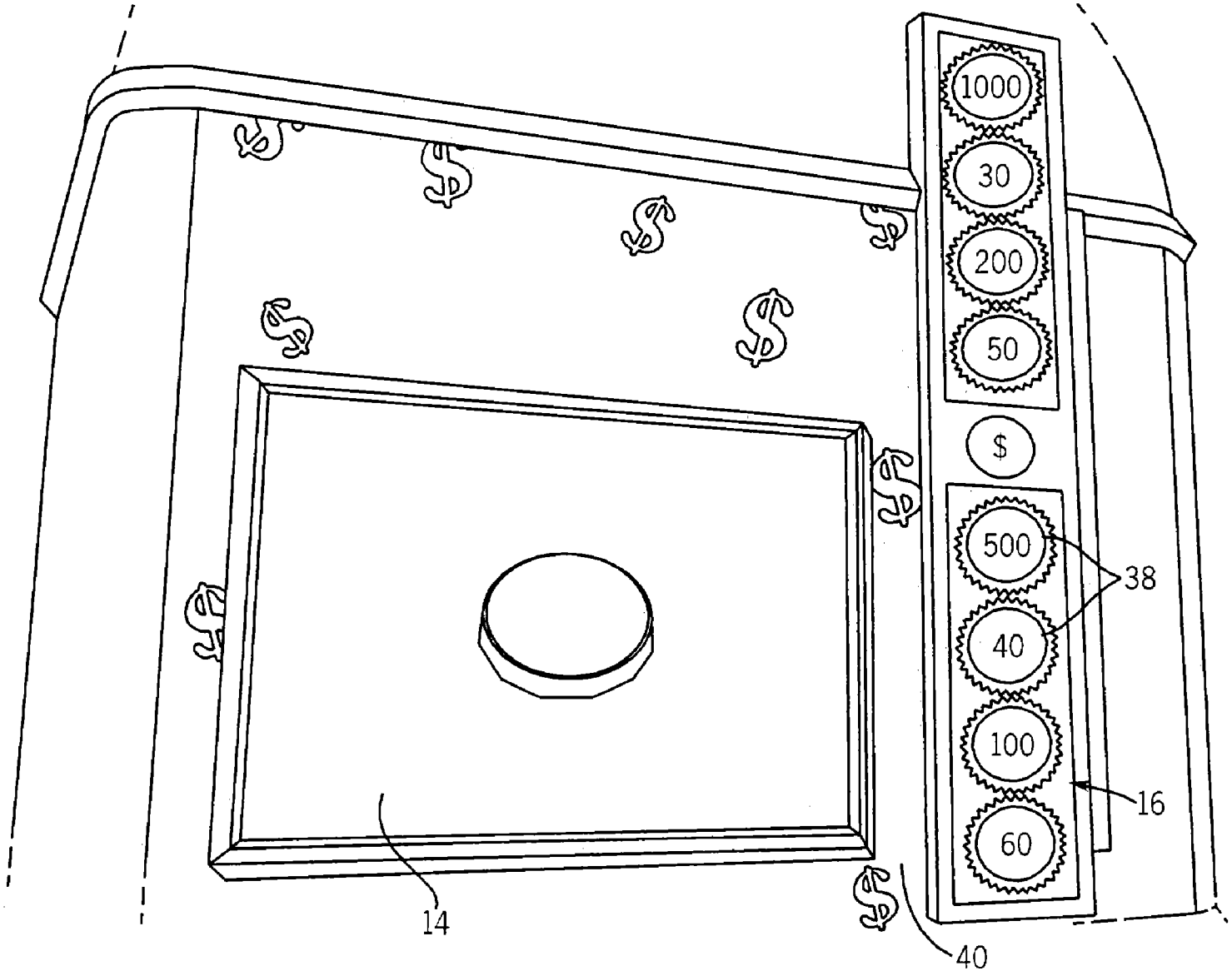
FIGS. 4 through 8 are enlarged perspective views of secondary displays of the gaming machine for displaying the bonus game.
Figure 5:
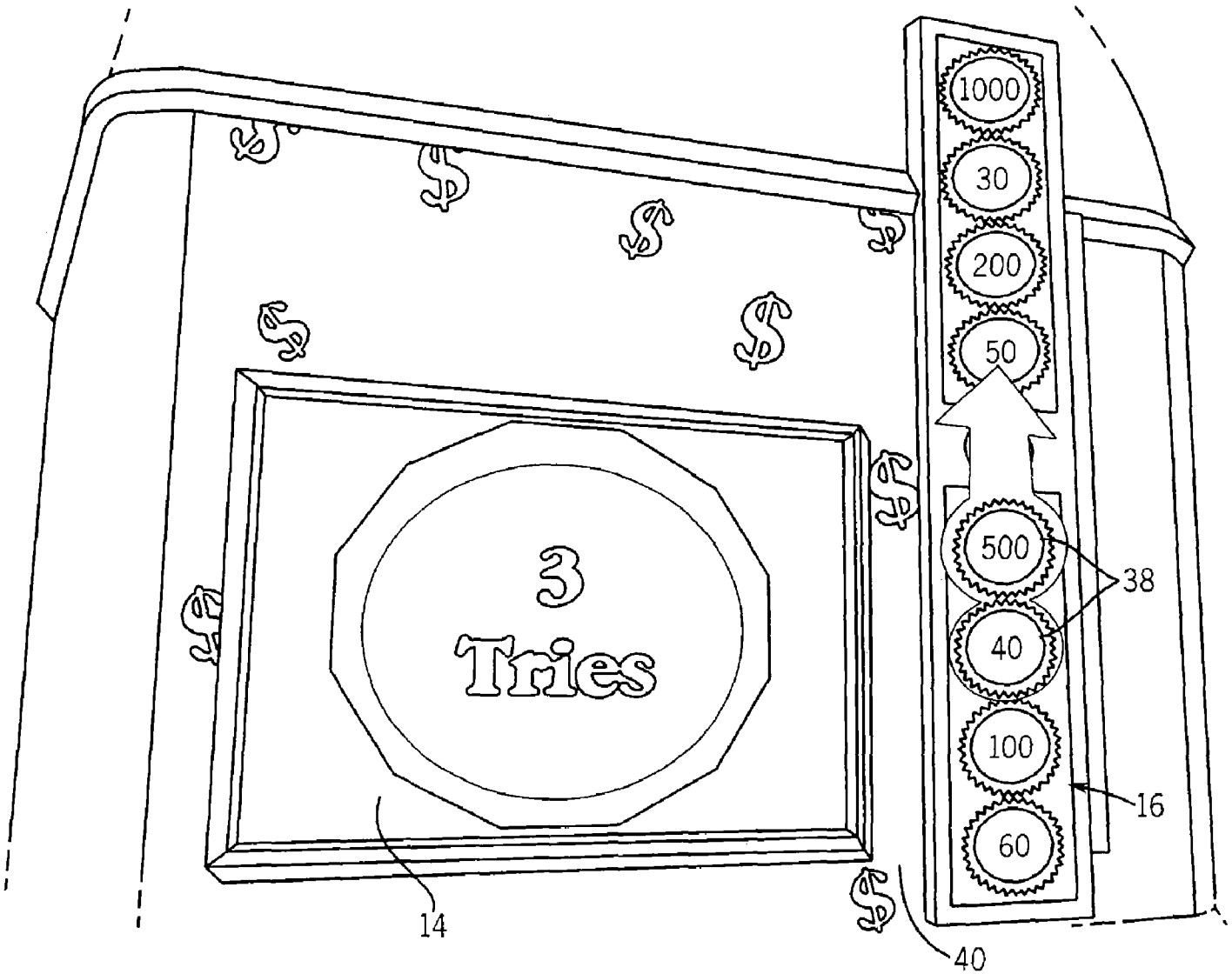

Referring to FIGS. 4 and 5, at the start of the bonus game the video display 14 above the reels depicts an animated bottle cap that zooms in and flips over to reveal a randomly selected number of opportunities to maximize an award in the bonus game. In the illustrated example, the bottle cap reveals three opportunities. The bonus game utilizes the electro-mechanical award display 16 including a plurality of physical elements 38 that represent soda bottles. The physical elements 38 are associated with respective outcomes and are adapted to reciprocate (i.e., move back and forth) between an extended position and a retracted position. In the illustrated embodiment, the outcomes are fixed credit values denoted by indicia marked on the physical elements 38. Alternatively, the outcomes may be variable and denoted by variable displays either on the physical elements 38 themselves or along side the elements 38. The outcomes may be credit values, multipliers, terminators (for terminating a segment or all of the bonus game), neutral, etc.

The gaming machine 10 includes a housing, and the physical elements 38 are movable inward and outward relative to a front panel 40 of the housing. In the illustrated embodiment, the physical elements 38 protrude from the panel 40 when in the extended position and are approximately flush with the panel 40 when in the retracted position. In another embodiment, the physical elements 38 are approximately flush with the panel 40 when in the extended position and are recessed relative to the panel 40 when in the retracted position. In yet another embodiment, the physical elements 38 protrude from the panel 40 when in the extended position and are recessed relative to the panel 40 when in the retracted position. In a further embodiment, the physical elements 38 are movable between an extended position (e.g., protrude from the panel 40), a recessed position (e.g., recessed relative to the panel 40), and a middle position (e.g., flush with the panel 40).

The physical elements 38 may be arranged in a variety of configurations. In the illustrated embodiment, the physical elements 38 are arranged in a vertical line. Alternatively, the physical elements 38 may be arranged in a horizontal or diagonal line, or may be arranged in a regular or irregular non-linear configuration. For example, the physical elements 38 may be arranged in a closed configuration such as an oval, circle, triangle, rectangle, pentagon, hexagon, octagon, or other polygonal shape.

As viewed by a player in front of the gaming machine 10, each physical element 38 may have a variety of shapes. In the illustrated embodiment, the physical elements 38 are circular to represent soda bottle caps. Alternatively, the physical elements 38 may have the shape of an oval, triangle, rectangle, pentagon, hexagon, octagon, or other polygonal shape.

The bonus game proceeds as follows. Referring to FIG. 5, the CPU causes the physical elements 38 to successively move outward (forward) to the extended position and inward (backward) to the retracted position. As each physical element 38 moves outward, it illuminates its associated outcome. As each physical element 38 moves inward, it darkens its associated outcome. The physical elements 38 move outward and inward in sequence from the bottom of the display 16, to the top of the display 16, back to the bottom of the display, and so on.

Figure 6:
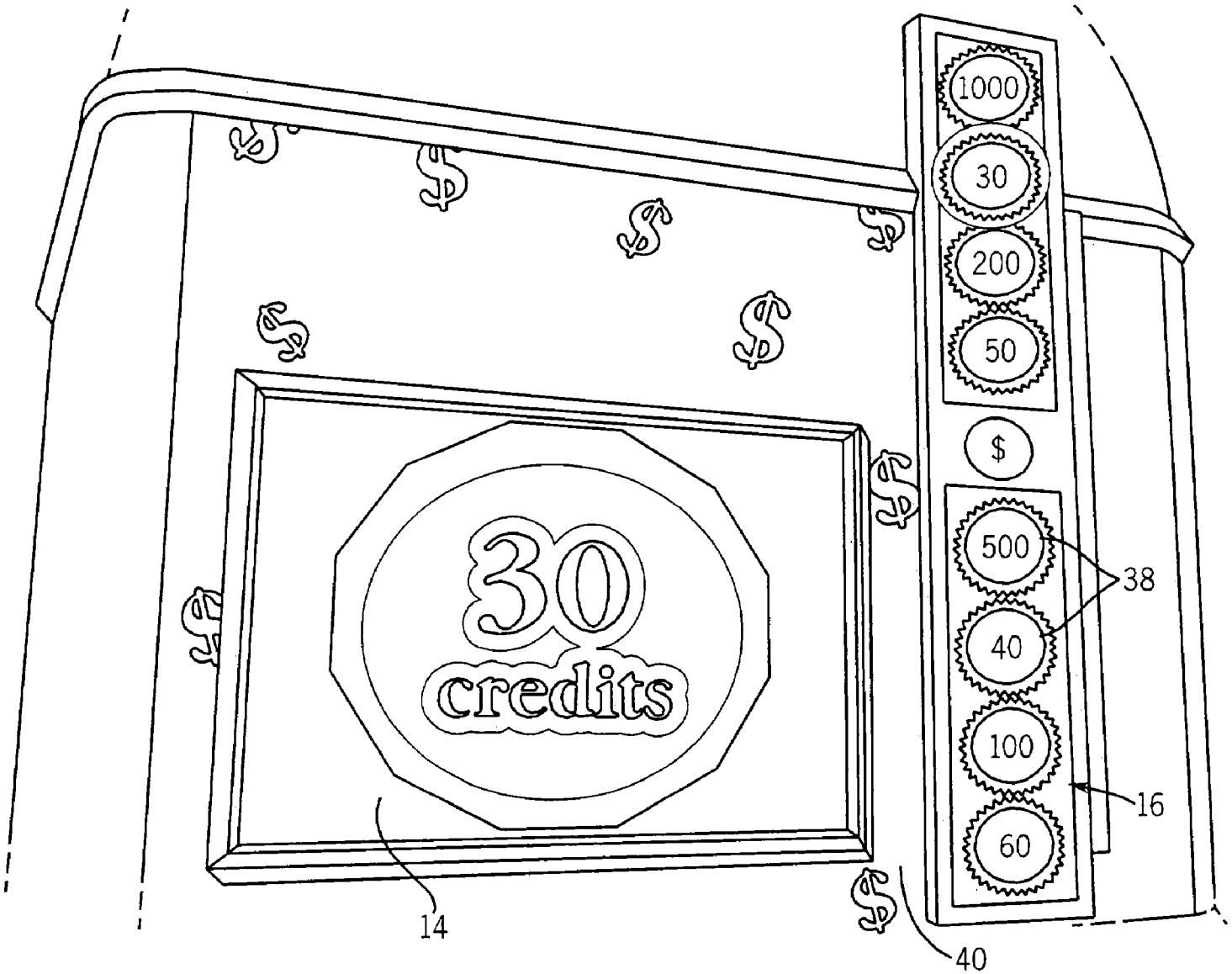

Referring to FIG. 6, the CPU causes the sequence of movement to slow down and stop with a single one of the physical elements 38 in the extended position. The single extended element 38 represents a current outcome. In the illustrated example, the single extended element 38 shows an award of 30 credits. At this point, the player is given the option of either keeping this award (e.g., by pressing a "keep win" button on the button panel 24) or trying again for a larger award (e.g., by pressing a "try again" button on the button panel 24). In the illustrated example, the player decides to try again for a larger award.

Figure 7:
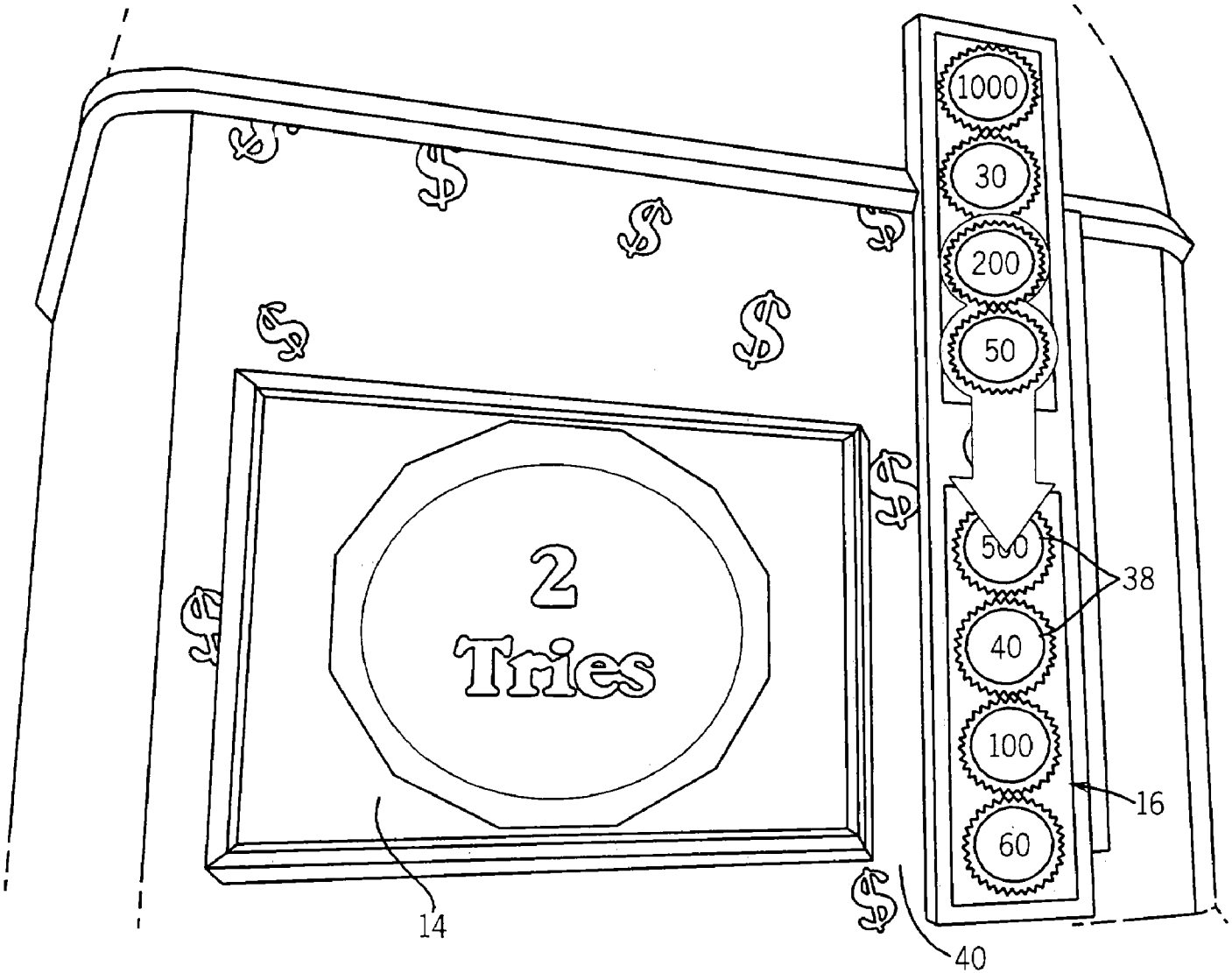

Referring to FIG. 7, the CPU once again causes the physical elements 38 to move in sequence. The display 14 indicates that the player has two opportunities remaining to maximize his/her award in the bonus game.

Figure 8:
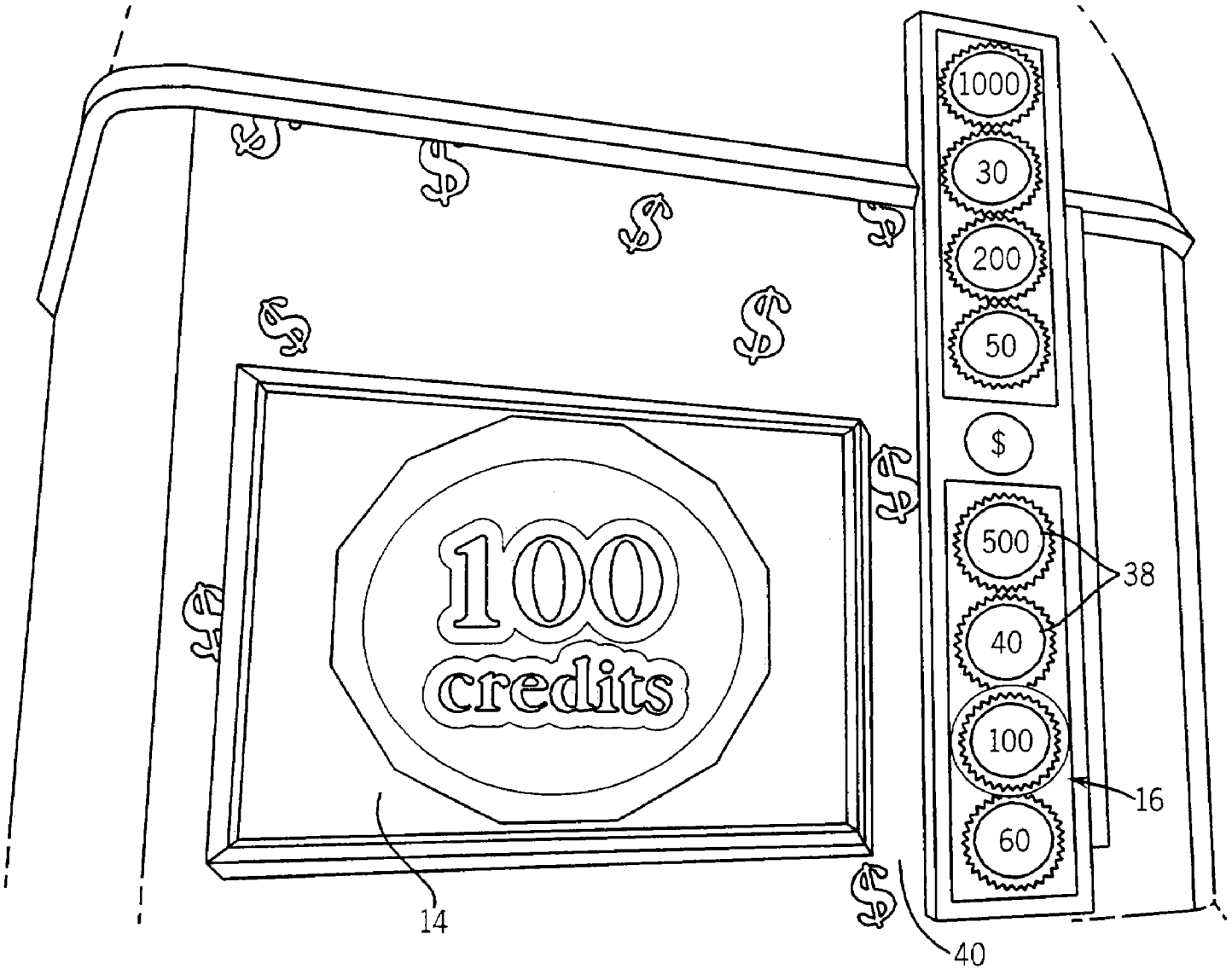

Referring to FIG. 8, this time the CPU causes the sequence of movement to slow down and stop on a physical element 38 worth 100 credits. In the illustrated example, the player decides to keep this award, thereby ending the bonus game and causing the CPU to shift operation back to the basic slot game.

While the present invention has been described with reference to one or more particular embodiments, those skilled in the art will recognize that many changes may be made thereto without departing from the spirit and scope of the present invention.

For example, instead of moving the physical elements 38 outward/forward toward a player and inward/backward away from the player, the physical elements 38 may move, in a reciprocating manner, upward and downward, leftward and rightward, or in other pairs of opposite directions. While a physical element 38 reciprocates between extended and retracted positions, the physical element 38 may also stop at one or more positions between the extended and retracted positions.

Further, the method of game play that utilizes the physical elements 38 may vary. For instance, the play method may be a "last man standing" method that can be implemented in a couple possible ways. In one implementation, all the physical elements 38 are illuminated and start in the extended position. One by one, each physical element 38 moves to the retracted position and darkens. The last illuminated element 38 represents the selected outcome. In another implementation, all the physical element 38 move forward and backward. One by one, each physical element 38 locks in the retracted position and darkens. The last element 38 still moving represents the selected outcome.

Each of these embodiments and obvious variations thereof is construed as falling within the spirit and scope of the claimed invention, which is set forth in the following claims.

What is claimed is:

1. A gaming apparatus for conducting a wagering game on a gaming machine having a housing, the gaming apparatus comprising:

an electro-mechanical award display, the award display including a plurality of physical elements each located at a different location on the housing and movable relative to a panel of the housing between a viewable extended position toward a player and a viewable retracted position away from the player, the physical elements bearing a viewable game outcome, the physical elements being moveable between the extended and retracted positions along a path perpendicular to the panel, and each of the moving physical elements being stopped in either the extended position or the retracted position; and wherein the location and position of each of the plurality of physical elements indicates an associated game outcome based on which of the physical elements are stopped in the extended position and which of the physical elements are stopped in the retracted position, the game outcome being viewable in both the extended and retracted positions regardless of whether the physical element is in the extended position or the retracted position.

2. The apparatus of claim 1, wherein the physical elements protrude from the panel when in the extended position and are approximately flush with the panel when in the retracted position.

3. The apparatus of claim 1, wherein the physical elements are approximately flush with the panel when in the extended position and are recessed relative to the panel when in the retracted position.

4. The apparatus of claim 1, wherein the physical elements are arranged in a line.

5. The apparatus of claim 1, wherein the physical elements are movable in sequence.

6. The apparatus of claim 1, further including a processor operative to move each of the physical elements between the extended position and the retracted position, stop each of the physical elements in either the extended position or the retracted position, and provide the outcome based on which of physical elements stop in the extended position and which of the physical elements stop in the retracted position.

7. The apparatus of claim 6, wherein the physical elements are associated with respective outcomes.

8. A gaming apparatus for conducting a wagering game, comprising:

an electro-mechanical award display including a plurality of physical elements; and a processor configured to record a wager to play the wagering game, and in response to a predetermined criterion, move the physical elements between an extended position and a retracted position to indicate a game outcome, each of the plurality of physical elements bearing a viewable indicia indicative of an associated game outcome; and during a single wagering game, stop each of the moving physical elements in either the extended position or the retracted position, and provide the outcome based on which of the physical elements stop in the extended position and which of the physical elements stop in the retracted position and the viewable indicia being viewable in both the extended and retracted positions regardless of whether the physical element is moved.

9. The apparatus of claim 8, further including a housing, the processor being operative to move the physical elements relative to a panel of the housing.

10. The apparatus of claim 9, wherein the physical elements protrude from the panel when in the extended position and are approximately flush with the panel when in the retracted position.

11. The apparatus of claim 9, wherein the physical elements are approximately flush with the panel when in the extended position and are recessed relative to the panel when in the retracted position.

12. The apparatus of claim 8, wherein the physical elements are arranged in a line.

13. The apparatus of claim 8, wherein the processor is operative to move the physical elements in sequence.

14. The apparatus of claim 8, wherein the predetermined criterion is a start-bonus outcome in a basic portion of the wagering game.

15. A method of conducting a wagering game on a gaming machine, the gaming machine including an electro-mechanical award display including a plurality of physical elements, the method comprising:

receiving a wager to play the wagering game including a basic game and a bonus game; and in response to a bonus game triggering outcome of the basic game, moving the physical elements between a viewable extended position toward a player and a viewable retracted position away from the player to indicate a bonus game outcome, the physical elements being moved between the extended and retracted positions along a path approximately perpendicular to a front panel of the gaming machine; and wherein each of the plurality of physical elements bear indicia indicating an associated bonus game outcome and the indicia are viewable in both the extended and retracted positions regardless of whether the physical element is moved.

16. The method of claim 15, wherein the physical elements protrude from the panel when in the extended position and are approximately flush with the panel when in the retracted position.

17. The method of claim 15, wherein the physical elements are approximately flush with the panel when in the extended position and are recessed relative to the panel when in the retracted position.

18. The method of claim 15, wherein the physical elements are arranged in a line.

19. The method of claim 15, wherein the physical elements move in sequence.

20. The method of claim 15, further including stopping each of the moving physical elements in either the extended position or the retracted position, and providing the bonus game outcome based on which of physical elements stop in the extended position and which of the physical elements stop in the retracted position.

* * * * *